US006575886B1

(12) United States Patent
Tanck et al.

(10) Patent No.: US 6,575,886 B1
(45) Date of Patent: Jun. 10, 2003

(54) HIGH SPEED WRAP-AROUND MULTIPACKER

(75) Inventors: Gary D. Tanck, Menasha, WI (US); Dennis L. Ramaker, Valders, WI (US); Mike E. Grunwald, Newton, WI (US)

(73) Assignee: Nigrelli Systems, Inc., Kiel, WI (US)

( * ) Notice: Subject to any disclaimer, the term of this patent is extended or adjusted under 35 U.S.C. 154(b) by 0 days.

(21) Appl. No.: 09/775,267

(22) Filed: Feb. 1, 2001

(51) Int. Cl.[7] ..... B31B 1/02; B31B 1/34

(52) U.S. Cl. ..... 493/81; 493/164; 493/172; 493/173; 493/309; 493/313; 493/315

(58) Field of Search ..... 493/164, 172, 493/173, 309, 313, 315, 318, 81

(56) References Cited

U.S. PATENT DOCUMENTS

| | | | | | |
|---|---|---|---|---|---|
| 3,633,470 | A | * | 1/1972 | Bingham | 493/310 |
| 3,937,131 | A | * | 2/1976 | Kellogg | 493/310 |
| 4,123,966 | A | * | 11/1978 | Buschor | 493/127 |
| 4,194,442 | A | * | 3/1980 | Martelli | 271/95 |
| 4,881,934 | A | * | 11/1989 | Harston et al. | 271/107 |
| 5,027,586 | A | * | 7/1991 | Ramaker | 493/316 |
| 5,061,231 | A | * | 10/1991 | Dietrich et al. | 271/95 |
| 5,102,385 | A | * | 4/1992 | Calvert | 493/315 |
| 5,104,369 | A | * | 4/1992 | Calvert | 493/315 |
| 5,415,615 | A | * | 5/1995 | Culpepper | 493/315 |
| 5,473,868 | A | * | 12/1995 | Antonio | 53/566 |
| 5,511,772 | A | * | 4/1996 | Ganz et al. | 271/108 |
| 5,613,828 | A | * | 3/1997 | Haddow et al. | 414/798.9 |
| 5,653,671 | A | * | 8/1997 | Reuteler | 271/150 |
| 5,716,313 | A | * | 2/1998 | Sigrist et al. | 493/438 |
| 5,928,123 | A | * | 7/1999 | Davis, Jr. | 493/313 |
| 6,101,787 | A | * | 8/2000 | Brintazzoli et al. | 53/389.1 |

FOREIGN PATENT DOCUMENTS

| | | | | |
|---|---|---|---|---|
| DE | 3633470 | * | 4/1987 | 210/738 |

* cited by examiner

*Primary Examiner*—Rinaldi I. Rada
*Assistant Examiner*—Gloria R Weeks
(74) *Attorney, Agent, or Firm*—Andrus, Sceales, Starke & Sawall, LLP

(57) ABSTRACT

A packaging machine for loading of individual articles into a product cartons that includes a rotary blank feeder and a rotary board erector. The rotary blank feeder includes a plurality of feeder arms each having a vacuum head. The feeder arms are each rotatable about a common axis of rotation and the entire folding arm assembly is rotatable about an offset secondary axis of rotation. Each vacuum head of the rotary blank feeder moves into contact with the lowermost planar carton blank contained with an overhead hopper and transfers the carton blank to a board feed conveyor. From the board feed conveyor, each carton blank enters into a rotary board erector having a plurality of folding arms rotatable at variable speeds about a common axis of rotation. The folding arms of the rotary board erector partially fold each planar carton blank for loading with individual articles.

25 Claims, 7 Drawing Sheets

HIGH SPEED WRAP-AROUND MULTIPACKER

BACKGROUND OF THE INVENTION

The present invention generally relates to an automated packaging machine for forming a wrap-around product carton. More specifically, the present invention relates to a high speed rotary blank feeder and rotary board erector that combine to sequentially remove a planar carton blank from a stack of carton blanks and partially fold the carton blank into the product carton such that the product carton can be loaded with articles.

Currently, automated packaging machines exist that automatically remove planar carton blanks from a stack and fold the pre-scored carton blanks into a product carton that can then be loaded with articles, such as a twelve-pack or twenty-four-pack of beverage containers. After the desired number of articles have been loaded into the partially folded product carton, additional downstream processing closes and seals the product carton for shipment. Although currently available automated packaging machines are capable of folding and loading a product carton as described, limitations exist as to the speed at which the product cartons can be formed and filled with a set of individual articles.

A significant limitation on the speed at which a product carton can be formed and filled is the rate at which individual carton blanks can be unstacked and partially folded into a state such that the carton can receive a set of individual articles. Specifically, a major limitation in currently available automated packaging machines is the rate at which individual carton blanks can be fed from a stack.

Currently, the most common method of removing planar carton blanks from the bottom of a hopper is to utilize a reciprocating vacuum head that travels upward into contact with the lowermost carton blank. When the vacuum head is in contact with the lowermost carton blank, a source of negative pressure attracts the carton blank to the vacuum cups on the vacuum head. Once the carton blank is in contact with the vacuum head, the vacuum head is retracted, which pulls the lowermost carton blank from the stack onto a conveyor assembly. Once the carton blank is on the conveyor assembly, the source of negative pressure is removed and the vacuum head reciprocates back up into contact with the lowermost carton blank.

As can be understood by the above description, the speed at which individual carton blanks can be fed from the hopper is limited by the reciprocating motion of the vacuum head. In addition to the reciprocating vacuum heads, the speed of current wrap-around multipackers is limited by the rate at which the planar carton blanks can be folded into a preliminary state that can receive the articles being packaged.

Therefore, a need exists for an automated wrap-around multipacker that includes a high speed blank feeder to feed planar carton blanks into the rest of the system. Further, a need exists for a board erector that can receive carton blanks from the blank feeder and fold the carton blanks into a partially folded product carton for loading with articles.

SUMMARY OF THE INVENTION

The present invention includes a novel carton blank feeding section and carton folding section for an automated high speed wrap-around multipacker. The blank feeding and carton folding sections of the present invention allow the wrap-around multipacker to increase its operational speed to significantly increase the number of articles that can be packaged by the entire system.

The carton blank feeding section includes a rotary blank feeder that is positioned beneath an overhead hopper containing a stack of planar carton blanks. The rotary blank feeder includes a plurality of feeder arms that are rotatable about a common axis of rotation. The plurality of feeder arms form an integral feeder arm assembly that is both rotatable about the common axis of rotation and rotatable about a second axis of rotation spaced from the common axis of rotation. The rotary movement of the feeder arm assembly about two axes of rotation allows the vacuum head formed on each of the feeder arms to move along an astroid-shaped path. The astroid-shaped path of movement of each vacuum head allows the rotary board feeder to pull the lowermost carton blank from the accumulated stack and move the carton blank vertically and laterally onto a board feed conveyor assembly.

Each of the vacuum heads formed on the feeder arms of the feeder arm assembly is independently rotatable relative to the feeder arm itself. A series of gears and internal belts allows the vacuum head to maintain a constant horizontal orientation such that the vacuum head can grasp and transfer the carton blank from the overhead hopper. The feeder arm assembly is operable such that each vacuum head moves upward into contact with the lowermost carton blank and applies a source of negative pressure to the lowermost carton blank to remove the carton blank from the accumulated stack. The inclusion of three separate feeder arms within the feeder arm assembly allows the rotary blank feeder to increase the rate at which carton blanks are removed from the accumulated stack.

After each planar carton blank has been removed from the overhead hopper, the planar carton blank is grasped by one of the folding arms of a rotary board erector. The rotary board erector includes a plurality of folding arms that each rotate about a common axis of rotation. The folding arms each include a folding head having a pair of grasping vacuum cups that contact the planar carton blank and hold the planar carton blank in contact with the folding head.

Each folding arm includes a cam slot that receives a drive pin used to rotate the folding arm about a common axis of rotation. Movement of the drive pin within the cam slot decreases the rotational speed of each folding arm as the folding arm rotates from an upright, grasping position to a bottom dead center unloading position. The decrease in rotational speed of each folding arm allows the rotary board erector to compensate for the differences in linear speed between the movement of the planar carton blank on the board feed conveyor and the linear movement of the carton blank once it has been partially folded by the rotary board erector.

Each folding head of the rotary board erector includes a grasping suction cup that attracts a portion of the carton blank as the carton blank is folded by a folding assembly positioned adjacent to the rotary board erector. The folding assembly includes a plurality of folding bars that contact and fold the carton blank about pre-scored lines on the carton blank. Once the carton blank has been folded, the carton blank is held in its folded position by the folding vacuum cup.

The rotary board erector positions each of the partially folded carton blanks within a pocket formed between lugs on a pair of pocket chains. The product chains transfer the partially folded carton blank to a downstream location where articles can be inserted into the partially folded carton blank.

As can be understood by the above description, the rotary blank feeder and rotary board erector of the present invention allow for an increase in the operational speed of the multipacker incorporating these components. The increase in operational speed of the multipacker results in an increase in operating efficiency and product output.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
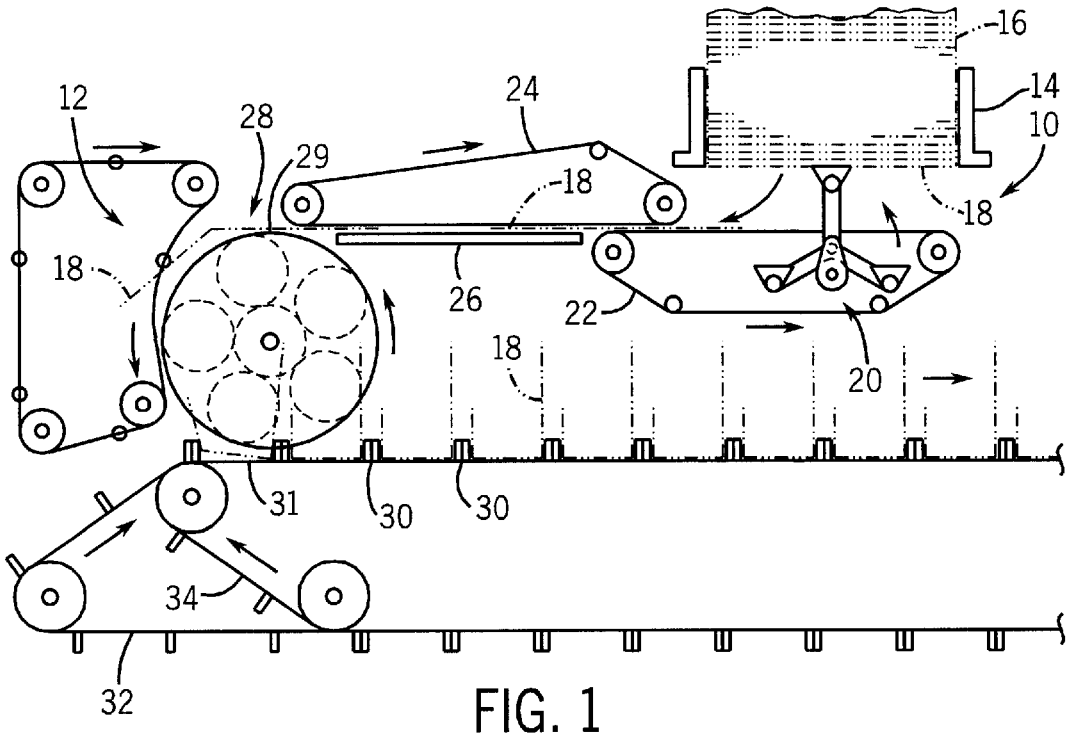
FIG. 1 is a side view of a blank feeding portion and a folding portion of a high speed wrap-around multipacker in accordance with the present invention.

Referring first to FIG. 1, thereshown is a carton blank feeding section 10 and a product carton folding section 12 of an automated high speed wrap-around multipacker. The entire high speed wrap-around carton multipacker functions to load a set of individual articles, such as beverage containers, into a product carton that is formed from a planar carton blank. The carton blank feeding section 10 and the folding section 12 illustrated in FIG. 1 function to partially form the product carton prior to its loading with articles in a downstream operating sequence.

Referring back to FIG. 1, the blank feeding section 10 includes an overhead hopper 14 positioned to support and accumulate a stack 16 of planar carton blanks 18. In the preferred embodiment of the invention, each of the planar carton blanks 18 is formed from either corrugated cardboard or paperboard. Each of the planar carton blanks 18 includes score lines that allow the planar carton blanks 18 to be folded into a product carton that wraps around a set of articles, such as multiple six-packs to create a twelve- or a twenty-pack of beverage containers.

As can be seen in FIG. 1, the lowermost carton blank 18 in the stack 16 is removed from the bottom of the stack 16 by a rotary blank feeder 20. The rotary blank feeder 20, as will be described in much greater detail below, operates to pull the lowermost carton blank 18 from the stack 16 and deposit the carton blank 18 onto a lower board feed conveyor 22. The lower board feed conveyor 22 transports the carton blank 18 away from the overhead hopper 14 until it is received between an upper board feed conveyor 24 and a stationary support platform 26. The combination of the lower board feed conveyor 22 and the upper board feed conveyor 24 transport the carton blank 18 from the rotary blank feeder 20 to a rotary board erector 28.

The rotary board erector 28 receives each of the carton blanks 18 and partially folds the carton blank 18 as the board erector 28 transports the carton blank from an upper, grasping position 29 to a lower, unloading position 31. When the carton blank moves into the lower, unloading position 31, the partially folded carton blank is positioned between a pair of lugs 30 contained on a pair of pocket chains 32 and 34. The lugs contained on each of the pocket chains 32 and 34 define a pocket that receives and transports the "J" shaped partially folded carton blanks 18 downstream, where the partially folded carton blank is loaded with articles, such as beverage containers.

As will be discussed in greater detail below, the combination of the rotary blank feeder 20 and the rotary board erector 28 allow the carton multipacker of the present invention to operate at substantially higher speeds as compared to previously available multipacker machines. Specifically, the multipacker incorporating the blank feeding section 10 and folding section 12 of FIG. 1 can be operated to load as many as 200 packages per minute, which is a significant improvement over the currently available systems that are typically capable of loading only 100 packages per minute.

Figure 2:
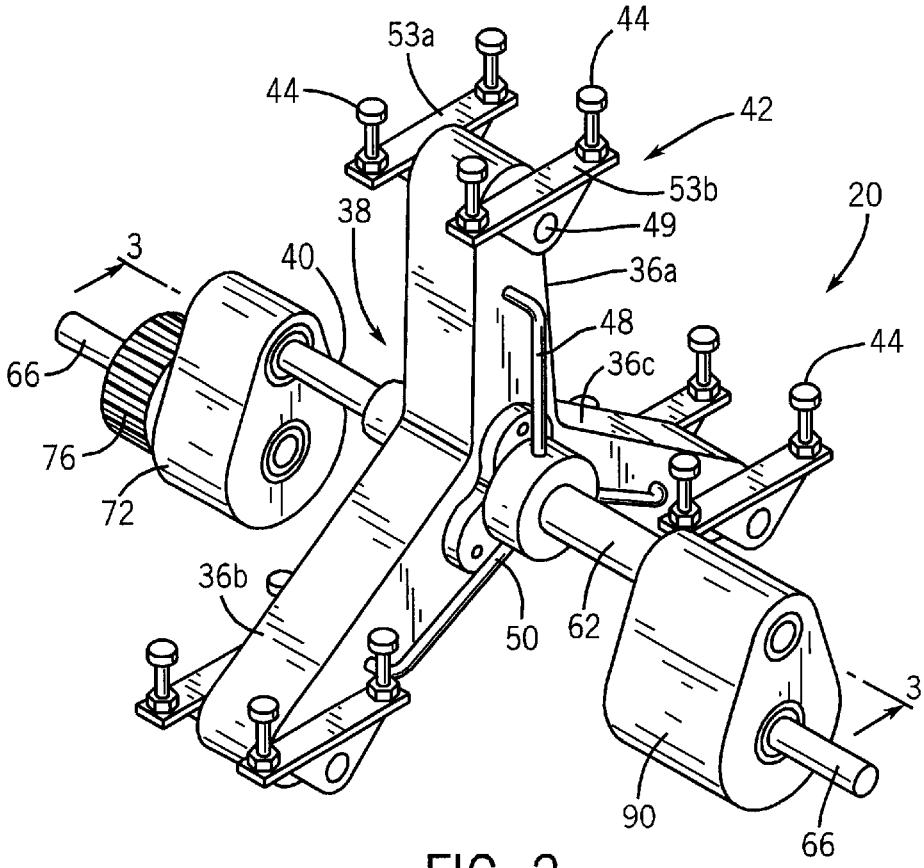
FIG. 2 is a perspective view of a rotary blank feeder used to unstack individual carton blanks from an accumulated stack.

Referring now to FIGS. 2–5, thereshown is the rotary blank feeder 20 of the present invention. As can be seen in FIG. 2, the rotary blank feeder 20 includes a plurality of individual feeder arms 36*a*, 36*b* and 36*c*. The feeder arms 36*a*–36*c* extend away from and are each rotatable about a common axis of rotation. The rotation of the feeder arms 36*a*–36*c* is controlled by a drive assembly, as will be described in detail below. In the preferred embodiment of the invention, the rotary blank feeder 20 includes three separate feeder arms 36*a*–36*c*, although it is contemplated by the inventor that two feeder arms 36 could be utilized while operating within the scope of the present invention.

As can be seen in FIG. 2, the feeder arms 36*a*–36*c* are joined to each other at their axial, inner ends to form a unitary feeder arm assembly 38. Each of the feeder arms 36*a*–36*c*, and thus the entire feeder arm assembly 38, is rotatable about a common axis of rotation that extends through and is defined by a center shaft 40. Thus, the entire feed arm assembly 38 is rotatable about the center shaft 40.

Figure 3:
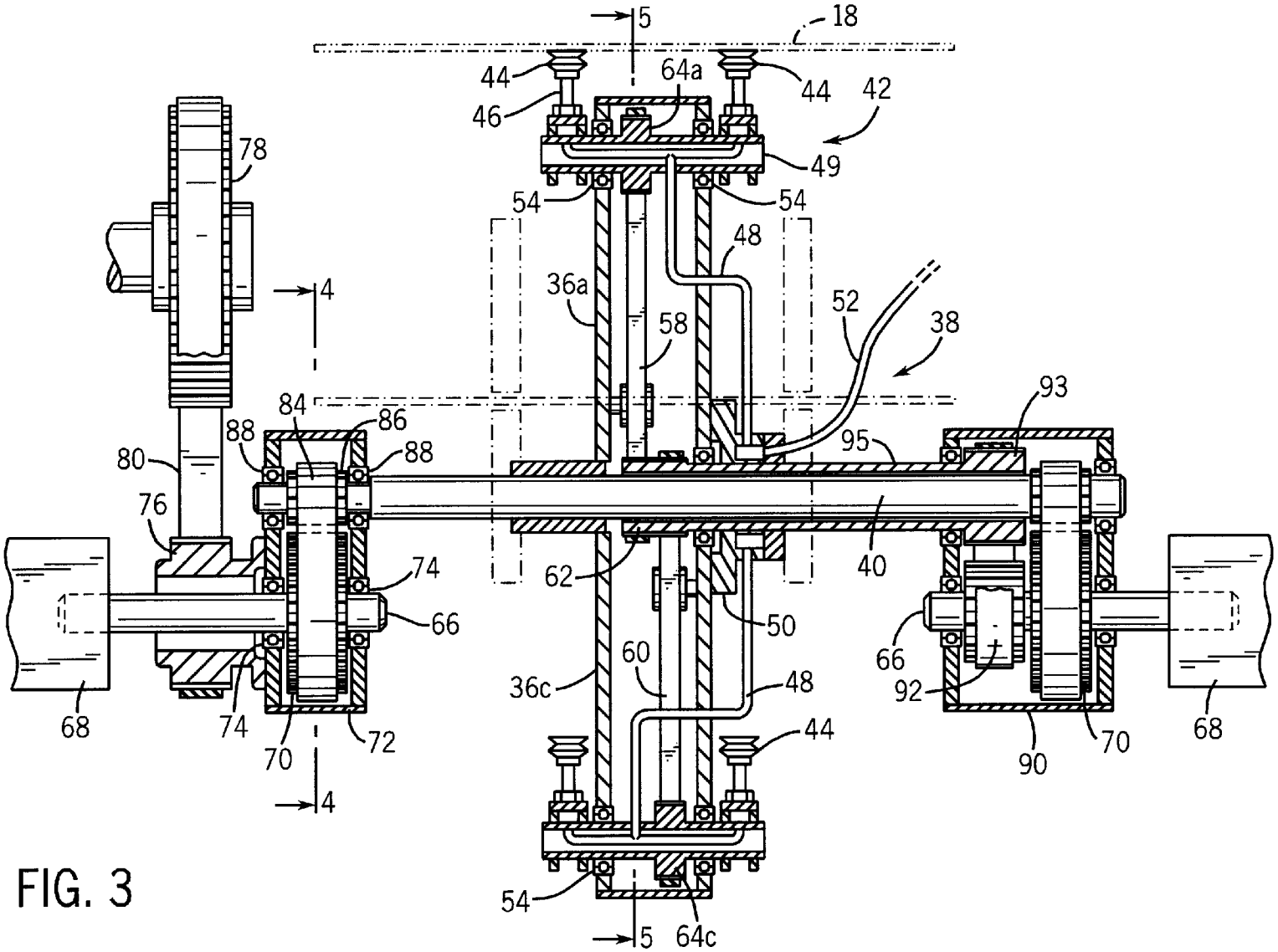
FIG. 3 is a section view taken along line 3—3 of FIG. 2 illustrating the detailed rotational connections contained in the rotary blank feeder of the present invention.

Each of the feeder arms 36*a*–36*c* includes a vacuum head 42 positioned on the radially outermost end of the respective feeder arm. Each vacuum head 42 includes a plurality of vacuum cups 44 that are connected to a supply of negative pressure. Referring to FIG. 3, each of the vacuum cups 44 is connected to a stem 46, which is connected to a vacuum line 48 that extends through a center tube 49. The vacuum line 48 connects to a rotary union 50 that receives a supply of negative pressure from a main pressure line 52. Since the entire feed arm assembly 38 is rotatable about the center shaft 40, the rotary union 50 allows for the rotating connection to the main vacuum line 52. Additionally, the rotary union 50 is configured such that the source of negative pressure is supplied to the vacuum cups 44 at the proper rotational positions, such that the vacuum cups 44 can hold the carton blank 18 in contact with the vacuum head 42 as the feeder arm rotates from the grasping position 29 to the unloading position 31.

As can be seen in FIG. 2, the vacuum cups 44 formed on the vacuum head 42 are supported on a pair of lateral arms 53*a* and 53*b* that are supported on the center tube 49. As shown in FIG. 3, the vacuum cups 44 contact the lower surface of the planar carton blank 18 when the feeder arm is in the uppermost, picking position such that the carton blank 18 is held in contact with the vacuum head 42 by the source of negative air pressure.

Figure 4:
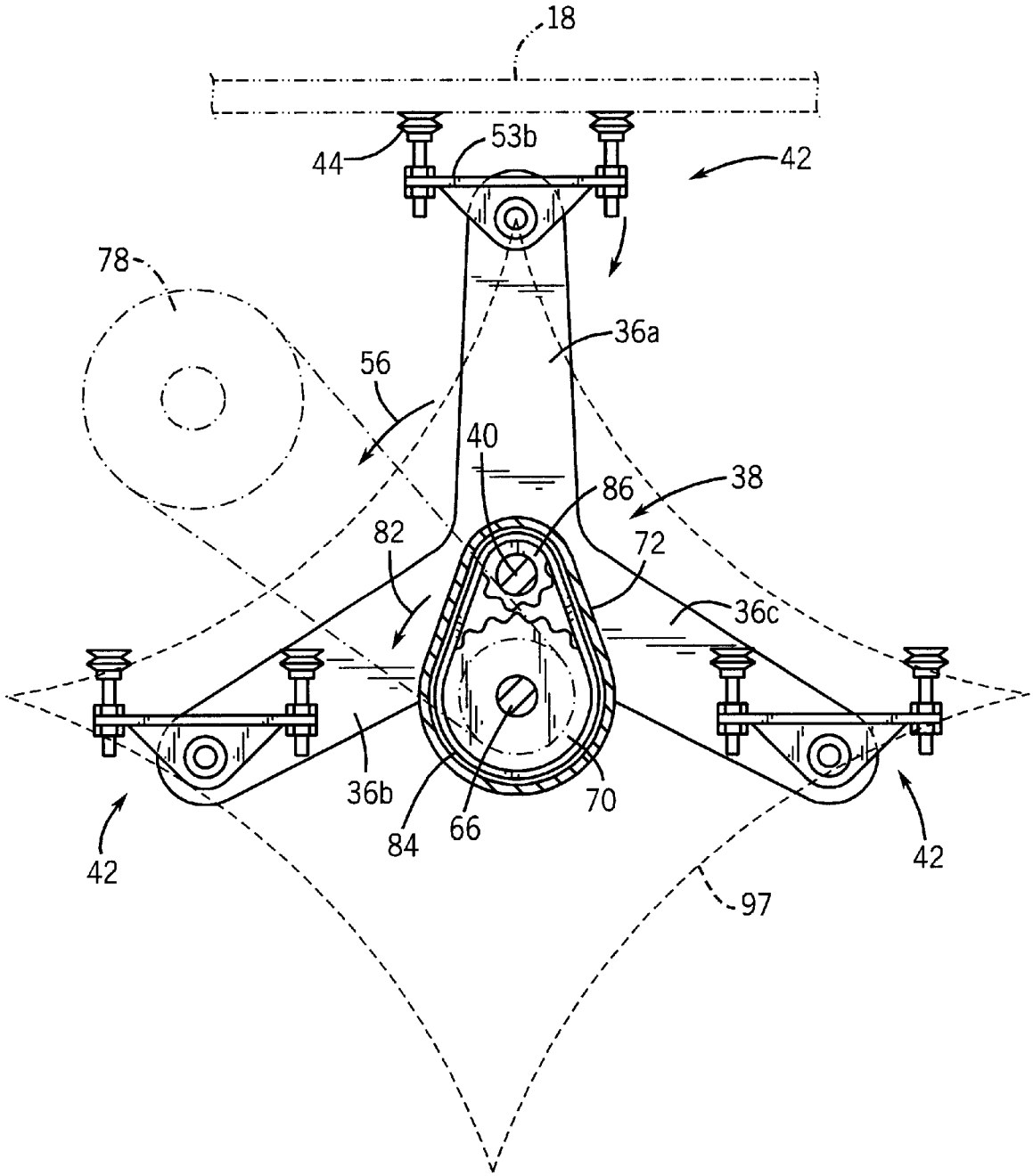
FIG. 4 is a view taken along line 4—4 of FIG. 3 illustrating the rotational movement of the rotary blank feeder during the process of unstacking and transferring a planar carton blank in accordance with the invention.

As can be seen in FIG. 3, the center tube 49 of each vacuum head is rotatably mounted to the respective feeder arm by a pair of bearings 54. The rotatable connection between the vacuum head 42 and the respective feeder arm 36*a*–36*c* allows the vacuum head 42 to maintain a constant horizontal orientation as the feeder arm assembly 38 rotates in a counter-clockwise direction about the center shaft 40, as illustrated by arrow 56 in FIG. 4. FIG. 4 clearly illustrates that each of the three vacuum heads 42 maintain a constant horizontal orientation throughout the entire 360° rotation of the feeder arm assembly 38.

Figure 5:
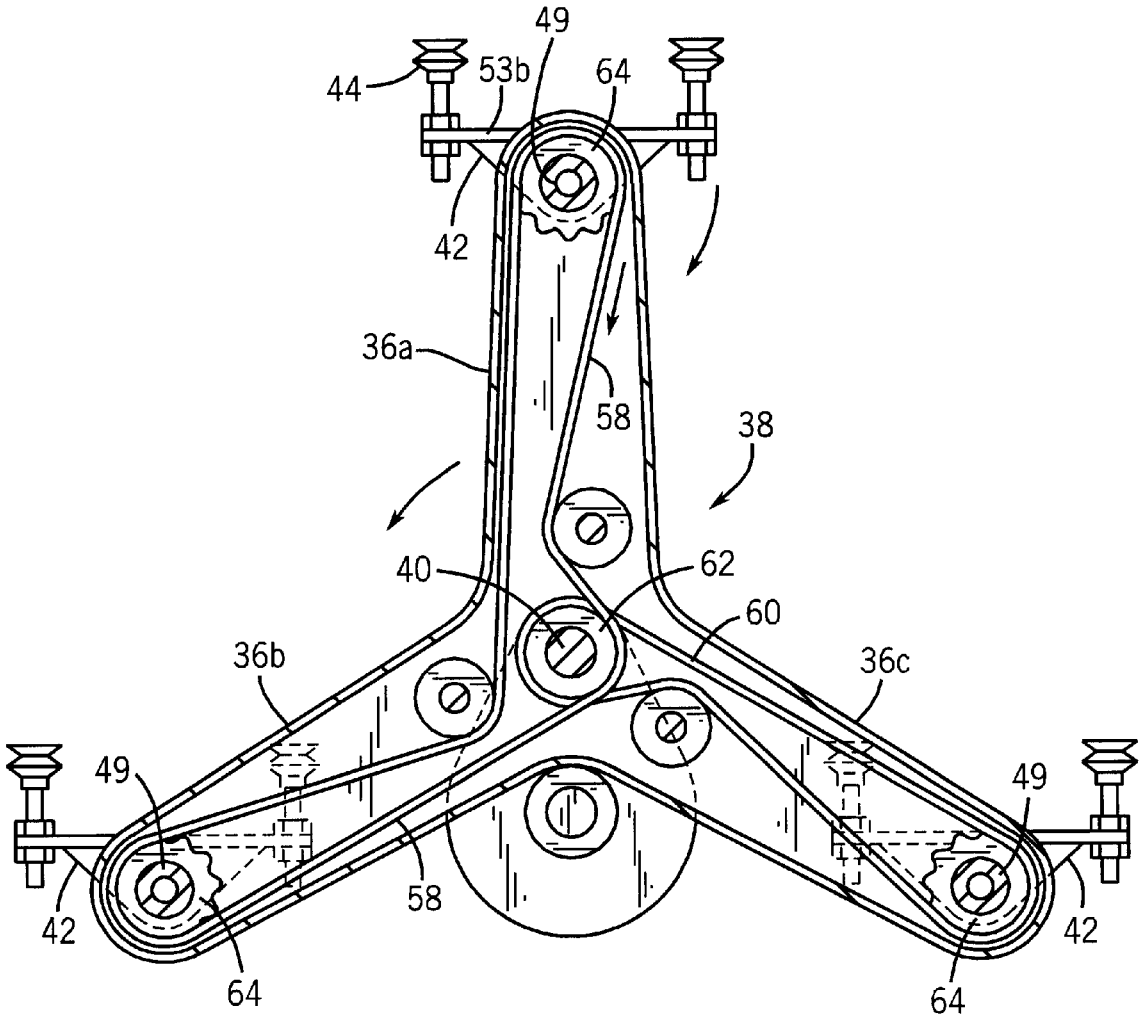
FIG. 5 is a view similar to FIG. 4, illustrating the operational connections that result in rotation of the rotary blank feeder in accordance with the present invention.

Referring now to FIG. 5, the rotation of each vacuum head 42 relative to its feeder arm 36*a*–36*c* is controlled by a pair of belts 58 and 60 that are driven by a center gear 62. Each of the belts 58 and 60 passes around a vacuum head gear 64 that is secured to the center tube 49 of the vacuum head 42. Thus, as the feeder arm assembly 38 rotates around the center shaft 40, the belts 58 and 60 cause the vacuum heads 42 to rotate about their bearings 54 and maintain a constant horizontal orientation. The constant horizontal orientation of the vacuum heads 42 is important to maintain the proper orientation of a carton blank 18 when the carton blank 18 is in contact with the vacuum head 42.

Referring now to FIG. 3, in addition to being rotatable about the common axis of rotation passing through the center shaft 40, the entire feeder arm assembly 38 is rotatable about a secondary rotational axis defined by a pair of stationary stub shafts 66 positioned on opposite sides of the feeder arm assembly 38. Each of the stub shafts 66 is securely mounted to a mounting block 68 and includes a stationary gear 70. An outer housing 72 is rotatable about the leftmost stationary stub shaft 66 in FIG. 3 by a pair of bearings 74.

The left housing 72 in FIG. 3 includes an outer gear 76 that is securely fixed to the housing 72. The outer gear 76 is coupled to a driven gear 78 by a belt 80. When the driven gear 78 is rotated, the belt 80 urges rotation of the outer gear 76. Since the stub shaft 66 and the stationary gear 70 are fixed, the rotation of the outer gear 76 causes the entire housing 72 to rotate in a counter-clockwise direction around the stationary gear 70, as illustrated by arrow 82 in FIG. 4. When the entire housing 72 rotates about the stub shaft 66, the entire feeder arm assembly 38 moves both vertically and horizontally, which translates into vertical and horizontal movement of the vacuum heads 42. The vertical movement of the vacuum heads 42 allows the vacuum heads 42 to move into contact with the lowermost carton blank 18.

As the housing 72 rotates in the counter-clockwise direction, the belt 84 extending around the stationary gear 70 and a center shaft gear 86 causes the center shaft 40 to rotate within the bearings 88. When the center shaft 40 begins to rotate, the entire feeder arm assembly 38 rotates in the counter-clockwise direction, as illustrated by arrow 56 in FIG. 4. At the same time, rotation of the right housing 90 in FIG. 3 about the stationary gear 70 causes a belt 92 to rotate the center gear 62 that surrounds the center shaft 40. The gear 93 is coupled to the center gear 62 by a cylindrical housing 95 such that the center gear 62 rotates with the gear 93. As discussed previously, rotation of the center gear 62 results in movement of the belts 58 and 60, resulting in the maintenance of a general horizontal orientation for each of the vacuum heads 42.

Referring now to FIG. 4, the compound and simultaneous rotation of the feeder arm assembly 38 about both the first axis of rotation passing through the center shaft 40 and rotation of the feeder arm assembly 38 about a second axis of rotation passing through each of the fixed, stationary gears 70 coupled to the stub shafts 66, results in movement of each vacuum head 42 along an astroid path 97 illustrated by dashed lines. As the feeder arm assembly 38 rotates about the stub shaft 66, each of the vacuum heads 42 moves upward into contact with the lowermost carton blank 18 when the feeder arm assembly 38 is in the position shown in FIG. 4. Further rotation of the feeder arm assembly 38 about the stationary gear 70 and the simultaneous rotation about the center shaft 40 moves the vacuum head downward and laterally with respect to the overhead hopper. In this manner, the rotary blank feeder 20 is able to extend upward to contact the lowermost blank in the stack and move the carton blank both laterally and downward onto the lower board feed conveyor 22, shown in FIG. 1.

As can be understood in the drawings of FIGS. 2–5, the rotary blank feeder 20 of the present invention is able to increase the speed of the multipacker by utilizing the three vacuum heads 42. Specifically, when the first vacuum head 42 is depositing the carton blank 18 on the lower board feed conveyor 22, the next vacuum head 42 is moving into position for grasping the next carton blank 18 in the stack 16 of the overhead hopper 14. Thus, the rotary blank feeder 20 is able to sequentially grasp the lowermost carton blank almost immediately upon the prior carton bland being placed onto the lower board feed conveyor 22. This is a significant improvement as compared to prior systems that utilize reciprocating vacuum heads.

Figure 6:
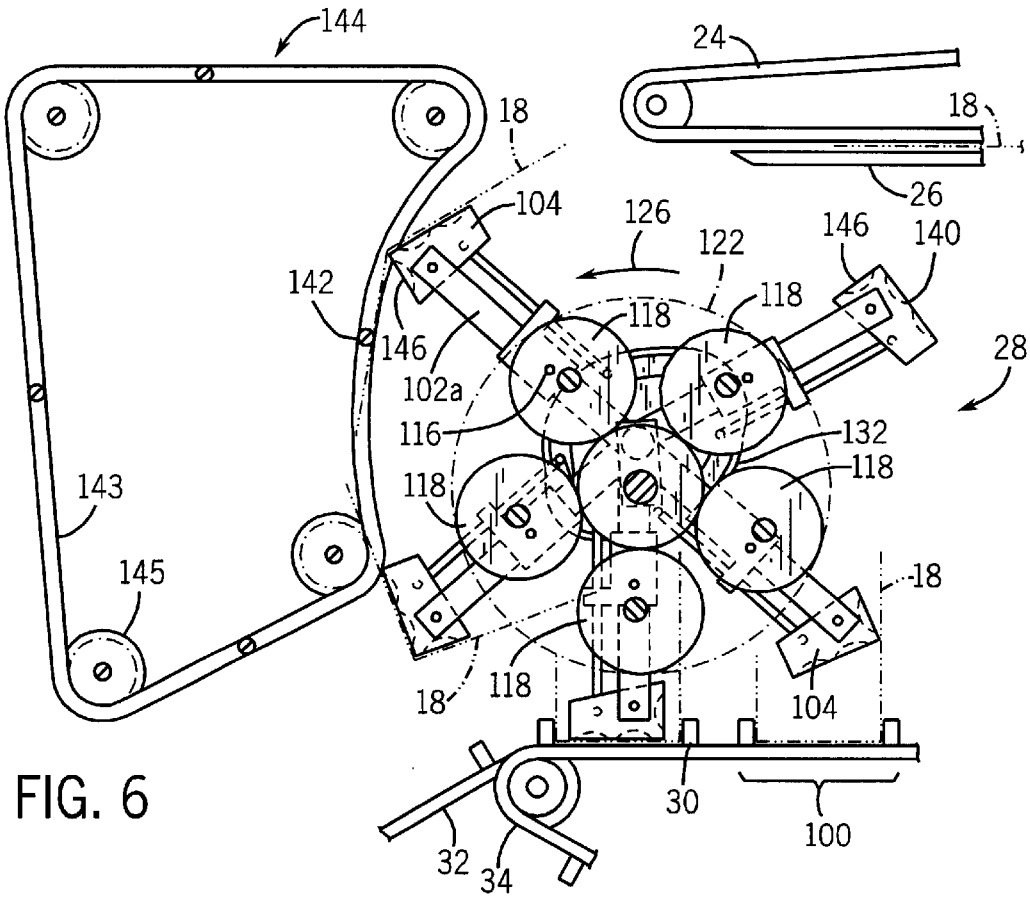
FIG. 6 is a side view of a rotary board erector used to partially fold the carton blank into the product carton in accordance with the present invention.

Referring now to FIG. 6, thereshown is the rotary board erector 28 of the present invention. The rotary board erector 28 is operable to receive each of the planar carton blanks 18 from the upper board feed conveyor 24 and transfer the carton blank 18 to a pocket 100 formed between a pair of lugs 30 on the pocket chains 32 and 34. As each of the planar carton blanks 18 are transferred from the upper board feed conveyor 24 to the pocket 100, the planar carton blank 18 is partially folded to the J-shape illustrated in FIG. 11. The partial folding of the carton blank 18 into the J-shape illustrated allows the carton blank 18 to be loaded with individual articles during downstream processing steps.

As can be understood in FIG. 6, the carton blanks 18 are moved along the upper board feed conveyor 24 at a first speed while the linear speed of the carton blanks 18 after they have been folded into the J-shape and are contained within the pocket 100 is a second speed. The second speed is less than the speed of the upper board feed conveyor 24 due to the decrease in linear length of the carton blanks as they are folded. Therefore, the rotary board erector 28 illustrated in FIG. 6 must slow the speed of the carton blanks as the carton blanks are transferred from the upper board feed conveyor 24 to the individual pockets 100 formed by the pair of pocket chains 32 and 34.

Figure 7:
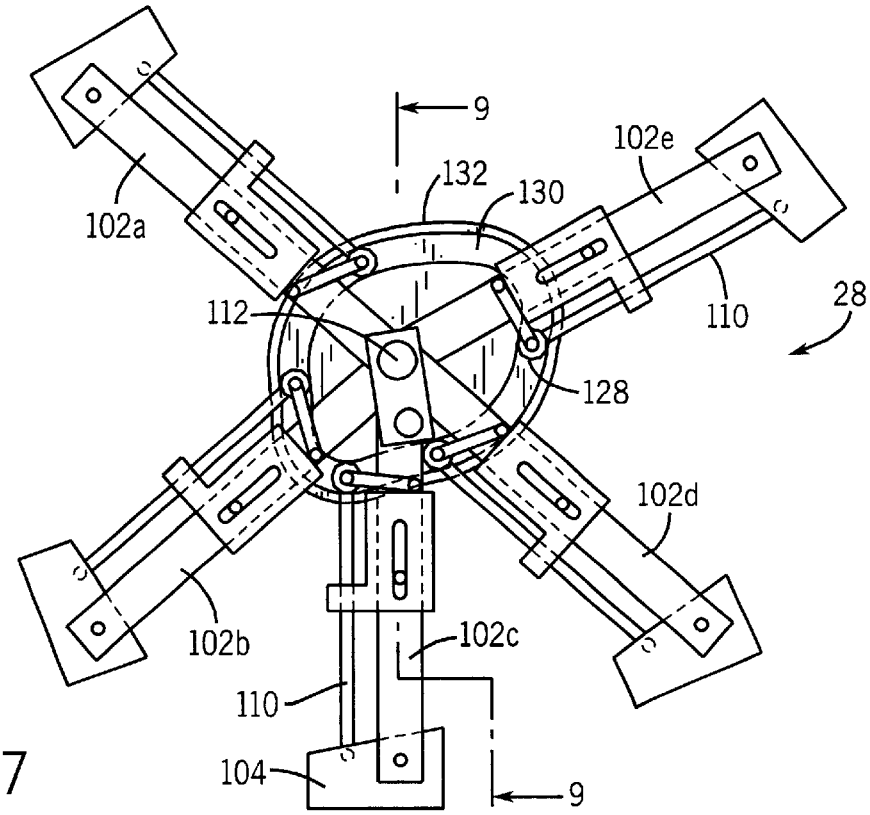
FIG. 7 is a side view illustrating the construction and position of the individual folding arms of the rotary board erector in FIG. 6.
Figure 8:
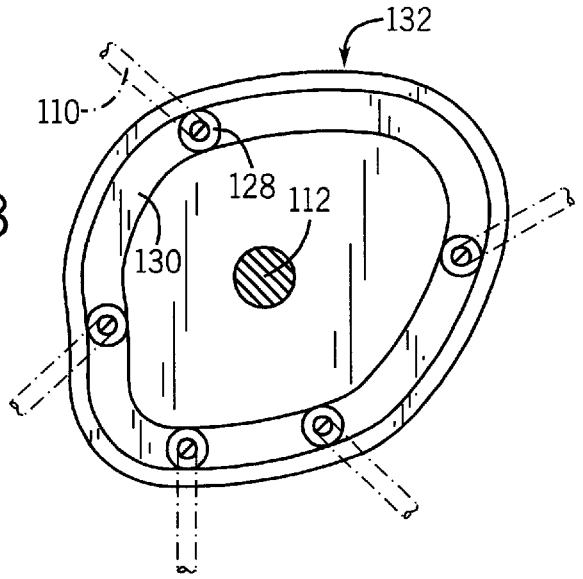
FIG. 8 is a magnified view illustrating a cam track used in controlling the rotational position of a folding head contained on each folding arm of the rotary board erector.
Figure 9:
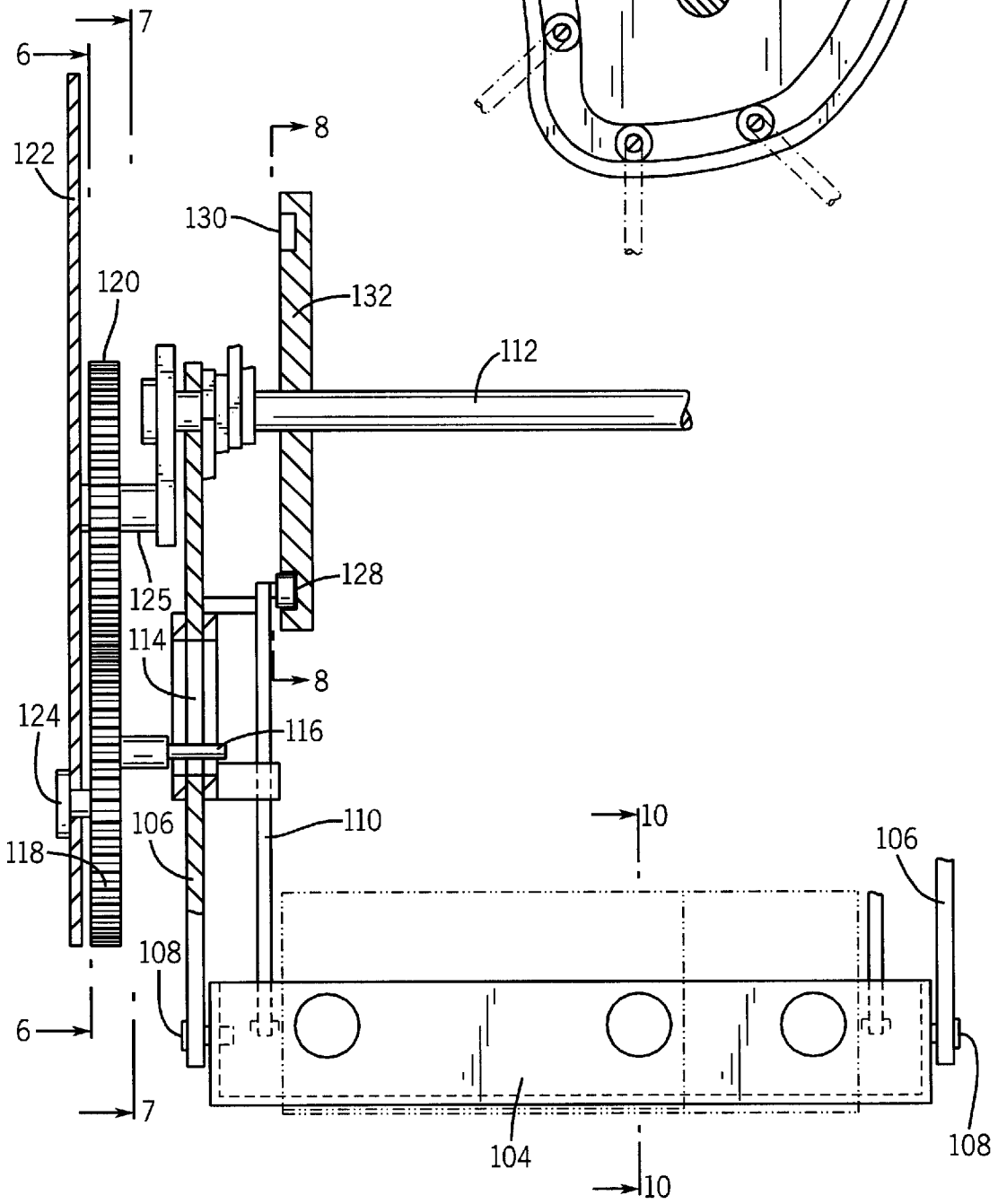
FIG. 9 is a section view taken along line 9—9 of FIG. 8.

Referring now to FIG. 7, the rotary board erector 28 includes a plurality of folding arms 102*a*–102*e* that are rotatable about a common axis of rotation. Referring now to FIG. 9, each of the folding arms 102*a*–102*e* includes a folding head 104 that is supported between a pair of side rails 106. Specifically, folding head 104 is pivotally mounted between the pair of side rails 106 by a pair of pivot pins 108. The pivot pins 108 allow the position of the folding head 104 relative to the side rails 106 to be adjusted by an adjustment rod 110.

As can be seen in FIG. 9, each of the folding arms 102 is rotatable about a common axis of rotation extending through a center shaft 112. The center shaft 112 forms the axis of rotation for all five of the folding arms 102*a*–102*e* illustrated in the preferred embodiment of the present invention.

Referring back to FIG. 6, each of the folding arms 102 is rotatable from a vertically upright grasping position, in which the folding head 104 contacts the carton blank 18 on the upper board feed conveyor 24, and a vertically oriented, unloading position in which the folding head 104 deposits the partially folded carton blank 18 into the pocket 100 formed between successive lugs 30 on the pocket chains 32 and 34. After depositing the partially folded carton blank 18 within one of the pockets 100, each of the folding arms 102*a*–102*e* continues its circular rotation until it returns to the upper, grasping position at which time it receives another carton blank 18.

Referring now to FIG. 9, each of the folding arms 102*a*–102*e* includes a cam slot 114 formed in one of its side rails 106. The cam slot 114 receives a drive pin 116 formed on the outer face of a follower gear 118 associated with the folding arm. As shown in FIG. 6, each of the folding arms 102*a*–102*e* includes its own follower gear 118. The follower gear 118 is intermeshed with a center drive gear 120. Each of the follower gears 118 is rotatably mounted to a drive plate 122 by a rotational shaft 124. The drive gear 120 is fixed to the drive plate 122, which rotates about a center of rotation.

As the drive plate 122 and the drive gear 120 rotate about a shaft 125, each of the follower gears 118 rotates due to the interaction with the drive gear 120. As each follower gear 118 rotates about its center of rotation, the drive pin 116 contacts the edge of the cam slot 114 to rotate the folding arm about the center shaft 112. Simultaneously, the drive pin 116 moves vertically within the cam slot 114. Thus, as the drive plate 122 rotates in the counter-clockwise direction, as illustrated by arrow 126 in FIG. 6, the follower gear 118 and drive pin 116 decreases the rotational speed of the folding arm 102 as the folding arm moves from the upright, grasping position to the bottom dead center, unloading position. The rotational speed of each folding arm 102*a*–102*e* is also affected by the offset between the shaft 125 and the center shaft 112. This decrease in speed compensates for the difference in linear length between the product blank prior to its folding and the linear speed of the partially folded carton blank.

After reaching the bottom dead center unloading position, the rotation of the follower gear 1 18 and the position of the drive pin 116 within the cam slot 114 increases the rotational speed of the folding arm 102*a*–102*e* until the speed of the folding arm matches the linear speed of the carton blank on the upper board feed conveyor 24.

Referring now to FIG. 7, each of the adjustment rods 110 includes a roller 128 that is movable within a roller track 130 formed in a guide plate 132. The guide plate 132 is positioned around the center shaft 112 and is stationary relative to the rotating drive plate 122. As each of the folding arms 102*a*–102*e* rotates about the center shaft 112, the position of the roller within the roller track 132 adjusts the angular orientation of the folding head 104 relative to its folding arm 102. Thus, the adjustment rod 110 is able to maintain the desired angular orientation of the folding head 104 relative to the folding arm 102. As can be seen in FIG. 6, the folding head 104 must be angled such that the folding head 104 can be removed from the J-shaped carton blank 18 when the carton blank 18 is within one of the pockets 100.

Figure 10:
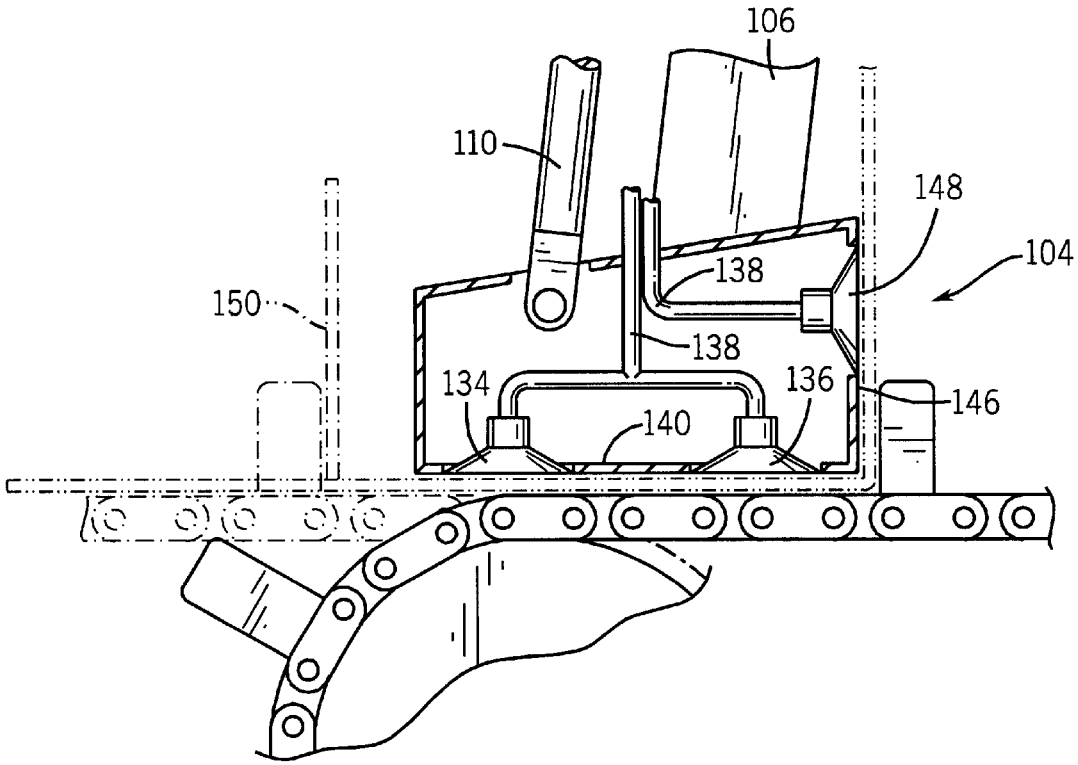
FIG. 10 is a section view taken along line 10—10 of FIG. 9 illustrating the operation of the folding head in folding the carton blank into the product carton.

Referring now to FIG. 10, each folding head 104 includes a pair of grasping vacuum cups 134 and 136 that are connected to a vacuum supply pipe 138. The grasping vacuum cups 134 and 136 extend through a bottom face 140 of the folding head 104. As can be understood in FIG. 6, the bottom face 140 of the vacuum head 104 comes into contact with the carton blank 18 when the carton blank 108 is supported by the upper board feed conveyor 24. When the bottom face 140 contacts the planar carton blank 18, the source of negative pressure through the grasping vacuum cups 134 and 136 allows the folding head 140 to support the carton blank and remove the carton blank from the upper board feed conveyor 24.

As each of the folding arms 102*a*–102*e* rotate in the counter-clockwise direction, one of the folding bars 142 of a folding assembly 144 contacts the carton blank 18 and causes the carton blank to fold around the folding head 104, as illustrated in FIG. 6. The folding bars 142 are mounted between a pair of chains 143 that are movable along a path defined by the guide rollers 145. The position of the folding bar 142 relative to the folding head 104 continues to fold the carton blank 18 until a portion of the carton blank contacts the leading edge 146 of the folding head. Referring back to FIG. 10, the leading edge 146 of the folding head 104 includes a folding vacuum cup 148 that is also connected to the vacuum supply pipe 138.

As the folding bar 142 folds the carton blank 18 around the folding head 104, the folding vacuum cup 148 aids in pulling the carton blank into contact with the leading edge 146 of the folding edge 104. In this manner, the folding head forms a 90° fold in the carton blank.

Figure 11:
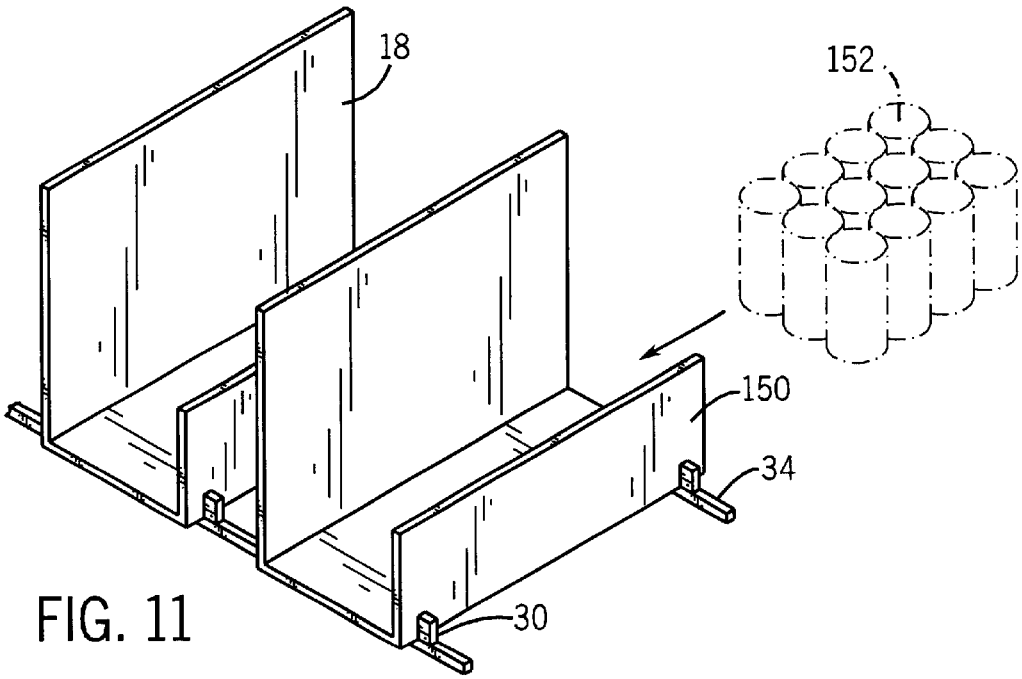
FIG. 11 is a perspective view illustrating the insertion of a set of individual articles into the partially folded carton blank.

In addition to the fold created by the folding head 104, the rear lug 30 that defines each of the pockets 100 contacts the carton blank and folds up a rear edge 150, as shown in FIG. 10. Thus, after the carton blank 18 leaves the rotary board erector 28, the carton has a general J-shape, as illustrated in FIG. 11. Once the carton has the J-shape, articles 152 can be loaded into the product carton, as illustrated. Further downstream processing will complete the folding process and seal the edges of the product carton in a conventional manner.

As can be understood by the above description of the invention, the rotary blank feeder 20 and the rotary board erector 28 constructed in accordance with the present invention allow the automated wrap-around multipacker to increase its operational speed, which in turn increases the number of individual articles that can be packaged by the entire machine. Specifically, the three rotating feeder arms of the rotary blank feeder dramatically increase the rate at which individual planar carton blanks can be picked from an overhead hopper and discharged onto a board feed conveyor assembly. The three rotating feeder arms are a vast improvement over reciprocating vacuum heads, as was currently available in the prior art.

In addition to the rotary blank feeder, the rotary board erector includes five folding arms that grasp, fold and place the partially folded carton blank within a pocket formed on a pair of chains. In this manner, the rotary board erector is able to transfer each of the planar carton blanks from the board feed conveyor to a pocket in which the partially folded carton blank can be loaded with a series of individual articles.

Various alternatives and embodiments are contemplated as being within the scope of the following claims particularly pointing out and distinctly claiming the subject matter regarded as the invention.

We claim:

1. An apparatus for forming a product carton, the apparatus comprising:

overhead hopper for accumulating a stack of planar carton blanks, each of which are to be folded into one of the product cartons;

a rotary blank feeder positioned beneath the overhead hopper to individually pull the planar carton blanks from the overhead hopper, the rotary blank feeder including a plurality of feeder arms joined to each other to form a feeder arm assembly, each of the feeder arms being rotatable about a common axis of rotation, each feeder arm including a vacuum head operable to grasp the lowermost carton blank from the overhead hopper, wherein the entire feeder arm assembly is rotatable about a secondary axis of rotation spaced from the common axis of rotation, wherein the rotation of the feeder arm assembly about the secondary axis of rotation moves the entire feeder arm assembly toward and away from the overhead hopper;

a board feed conveyor positioned to receive the planar carton blanks from the rotary blank feeder and move the planar carton blanks away from the overhead hopper; and a rotary board erector positioned to receive the planar carton blank from the board feed conveyor and fold the planar carton blank into the product carton, wherein the rotary board erector transfers the partially folded carton blank to a loading pocket such that the carton blank can be loaded.

2. The apparatus of claim 1 wherein the secondary axis of rotation is defined by a stationary gear spaced from the common axis of rotation of the feeder arm assembly such that the simultaneous rotation of the feeder arm assembly about the common axis and the secondary axis causes each vacuum head to move along an astroid-shaped path.

3. The apparatus of claim 1 wherein each vacuum head is rotatably mounted to its feeder arm, wherein the vacuum head maintains a constant horizontal orientation as the feeder arm rotates about the common axis of rotation.

4. The apparatus of claim 1 wherein the rotary board erector includes a plurality of folding arms each rotatable about a common axis of rotation.

5. The apparatus of claim 4 wherein each folding arm includes a folding head operable to grasp the carton blank from the board feed conveyor and partially fold the carton blank as the folding arm rotates from a first, grasping position to a second, unloading position.

6. The apparatus of claim 5 wherein the grasping position and the unloading position are spaced by 180°.

7. The apparatus of claim 6 wherein the rotational speed of the folding arms changes from the grasping position to the unloading position.

8. The apparatus of claim 5 wherein the folding head includes at least one grasping vacuum cup positioned to contact the planar carton blank when the folding arm is in the grasping position, the grasping vacuum cup being connected to a source of negative pressure.

9. The apparatus of claim 8 wherein the folding head further includes at least one folding vacuum cup operable to grasp the carton blank when the carton blank is partially folded.

10. The apparatus of claim 9 wherein the grasping vacuum cup and the folding vacuum cup are positioned at right angles to each other such that the folding vacuum cup contacts the carton blank when the carton blank is partially folded.

11. The apparatus of claim 5 further comprising a folding assembly positioned adjacent to the board erector, the folding assembly including a plurality of folding bars each movable into contact with the carton blanks as the carton blanks are moved from the grasping position to the unloading position by the folding arms, wherein the folding bars partially fold the carton blanks.

12. The apparatus of claim 11 wherein the folding head includes a grasping vacuum cup positioned to contact the planar carton blank when the folding arm is in the grasping position.

13. The apparatus of claim 12 wherein the folding head further includes a folding suction member operable to grasp the folded portion of the carton blank when the carton blank is folded by one of the folding bars on the folding assembly.

14. An apparatus for removing a planar carton blank from a stack of carton blanks stacked within an overhead hopper, the apparatus comprising:

a plurality of feeder arms each rotatable about a common axis of rotation, wherein the plurality of feeder arms are joined to each other to form a feeder arm assembly, wherein the entire feeder arm assembly is rotatable about a secondary axis of rotation spaced from the common axis of rotation, wherein the rotation of the feeder arm assembly about the secondary axis of rotation moves the entire feeder arm assembly toward and away from the overhead hopper;

a vacuum head positioned on each of the feeder arms, the vacuum head being operable to grasp the planar carton blank from the overhead hopper; and a board feed conveyor positioned to receive the carton blanks from each of the feeder arms, wherein the board feed conveyor moves the carton blanks away from the overhead hopper.

15. The apparatus of claim 14 wherein the feeder arm assembly includes three feeder arms.

16. The apparatus of claim 14 wherein the vacuum heads on each of the feeder arms are movable toward and away from the overhead hopper as the feeder arm assembly simultaneously rotates about the common axis and the secondary axis.

17. The apparatus of claim 16 wherein each vacuum head is rotatably mounted to the feeder arm such that the vacuum head maintains a constant horizontal orientation as the feeder arm assembly rotates about both the common axis of rotation for the feeder arm assembly and around the secondary axis of rotation.

18. The apparatus of claim 17 wherein each of the vacuum heads moves along an astroid-shaped path.

19. A rotary board erector for folding a planar carton blank into a product carton, the rotary board erector comprising:

a board feed conveyor operable to feed a plurality of planar carton blanks from a supply source;

a plurality of independently movable folding arms each rotatable about a common axis of rotation between a first grasping position and a second unloading position, wherein the rotational speed of each folding arm about the common axis changes from the grasping position to the unloading position; and a folding head positioned on each of the folding arms to grasp the planar carton blanks from the board feed conveyor when the folding arm is in the first grasping position and fold the carton blank as the folding arm rotates to the second unloading position.

20. The rotary board erector of claim 19 wherein the grasping position and the unloading position are 180° apart.

21. The rotary board erector of claim 19 wherein the folding head on each folding arm includes at least one grasping vacuum cup positioned to contact the planar carton blank when the folding arm is in the grasping position and at least one folding vacuum cup operable to grasp the carton blank when the carton blank is partially folded.

22. The rotary board erector of claim 21 wherein the grasping vacuum cup and the folding vacuum cup member are positioned at right angles to each other.

23. The rotary board erector of claim 19 further comprising a folding assembly positioned adjacent to the rotating folding arms, the folding assembly including a plurality of folding bars movable into contact with the carton blanks as the carton blanks are moved from the grasping position to the unloading position by the folding arms, wherein the folding assembly is operable to partially fold the carton blank when the carton blank is held by the folding arm.

24. The rotary board erector of claim 23 wherein the folding head includes at least one grasping vacuum cup positioned to contact the planar carton blank when the folding arm is in the grasping position and a folding vacuum cup positioned to grasp the carton blank after the carton blank is partially folded by the folding assembly.

25. The rotary board erector of claim 24 wherein the grasping vacuum cup and the folding vacuum cup are positioned orthogonally to each other.

* * * * *